US005515964A

United States Patent [19]

Bauman

[11] Patent Number: 5,515,964

[45] Date of Patent: May 14, 1996

[54] CONTACT LENS PACKAGE WITH LENS RETAINING RECESS

[76] Inventor: Robert C. Bauman, 232 Goodhouse Rd., Litchfield, Conn. 06759

[21] Appl. No.: 421,216

[22] Filed: Apr. 13, 1995

[51] Int. Cl.[6] ..... A45C 11/04

[52] U.S. Cl. ..... 206/5.1; 206/210

[58] Field of Search ..... 206/5.1, 207, 210, 206/461, 469; 134/901

[56] References Cited

U.S. PATENT DOCUMENTS

| | | | |
|---|---|---|---|
| D. 210,248 | 2/1968 | Nissel . | |
| 2,816,666 | 12/1957 | Nadel . | |
| 2,948,387 | 8/1960 | Fishman | 206/5.1 |
| 3,089,500 | 5/1963 | Stalcup | 206/5.1 |
| 3,186,540 | 6/1965 | Berger . | |
| 3,268,068 | 8/1966 | LeGrand . | |
| 3,311,229 | 3/1967 | Troll et al. . | |
| 3,371,777 | 3/1968 | Lilly . | |
| 3,495,759 | 2/1970 | Bergstrom et al. . | |
| 3,780,856 | 12/1973 | Braverman . | |
| 3,977,517 | 8/1976 | Kadlecik et al. . | |
| 3,990,579 | 11/1976 | Manning . | |
| 4,091,917 | 5/1978 | Clawson et al. . | |
| 4,332,318 | 6/1982 | Feldman . | |
| 4,392,569 | 7/1983 | Shoup . | |
| 4,508,216 | 5/1985 | Kelman . | |
| 4,543,882 | 10/1985 | Ryder et al. . | |
| 4,545,478 | 10/1985 | Waldman . | |
| 4,605,127 | 8/1986 | Magnussen, Jr. . | |
| 4,691,320 | 9/1987 | Martinez . | |
| 4,697,703 | 10/1987 | Will . | |
| 4,710,023 | 12/1987 | Loveridge . | |
| 4,897,981 | 2/1990 | Beck . | |
| 4,981,165 | 1/1991 | Ryder . | |
| 5,054,610 | 10/1991 | Ajello . | |
| 5,071,276 | 12/1991 | Nielsen et al. . | |
| 5,101,967 | 4/1992 | Sibley . | |
| 5,199,559 | 4/1993 | Dark . | |
| 5,337,888 | 8/1994 | Morrison . | |

FOREIGN PATENT DOCUMENTS

| | | | |
|---|---|---|---|
| 48-3151 | 1/1973 | Japan | 206/5.1 |

*Primary Examiner*—Thomas P. Hilliard
*Attorney, Agent, or Firm*—Pepe & Hazard

[57] ABSTRACT

A lens storage container includes an integrally formed receptacle member having a spheroidal well providing a concave recess in which the lens is disposed. In some embodiments, a lip extends about a portion of the periphery of the well to maintain the lens in the well therebelow. In other embodiments, a depending portion on the closure extends into the well to keep the lens in position. A closure extends across the well and is secured to the receptacle.

9 Claims, 2 Drawing Sheets

CONTACT LENS PACKAGE WITH LENS RETAINING RECESS

BACKGROUND OF THE INVENTION

The present invention relates to contact lens storage containers, and, more particularly, to disposable storage containers for contact lenses.

Many different types of containers have been used for storage of contact lenses. Some of these are relatively durable molded structures intended for repeated use and include replaceable covers. Others are relatively low cost disposable structures for storage of the lens only prior to opening and use of the lens by the wearer. Recently, the increasing use of disposable contact lens has resulted in efforts to produce lower cost disposable containers.

All such storage containers must be relatively free from leakage of liquid and vapor to ensure that the lens will be immersed in the liquid within the container or exposed to a highly moist atmosphere so that the lens retains its high moisture content. Typical disposable lens containers have a molded receptacle and a metal foil or plastic sheet cover which can be peeled therefrom.

Some permanent lens storage containers have employed complex structures for seating the lens at a specific position within the container. Illustrative of such containers are Ryder U.S. Pat. No. 4,981,657 which has a hanger with spheric surfaces to seat the contact lens and Kadlecik et al U.S. Pat. No. 3,977,517. Manning U.S. Pat. No. 5,990,579 provides a container with a base providing a convex surface and a cap with a concave surface to locate the lens therebetween. Shoup U.S. Pat. No. 4,392,569 employs a similar combination of convex/concave opposed surfaces. Waldman U.S. Pat. No. 4,545,478 positions the lens on a hanger molded on the cap between opposed concave/convex surfaces. Clawson et al U.S. Pat. No. 4,091,917 provides a concave surface on the cover to which the lens will adhere.

As can be seen, these are all relatively complex structures which are relatively expensive to fabricate.

It is an object of the present invention to provide a novel disposable contact lens storage container for locating the lens and enabling its facile removal from the container in a predetermined orientation.

It is also an object to provide such a container which reduces the potential for damaging the lens during removal.

A further object is to provide such a container which may be fabricated readily and economically.

SUMMARY OF THE INVENTION

It has now been found that the foregoing and related objects may be readily attained in a contact lens package comprising a container providing a well with a concave surface having a first radius of curvature. Disposed in the well adjacent the concave surface is a concave contact lens, and it has a second radius of curvature which may vary slightly from that of the container concave surface but which approximates it. A saline solution is also disposed in the well about the lens. A removable cover extends over the container to seal the contact lens and saline solution in the well. Either the cover or the container well has retaining means extending inwardly of the concave surface of the well at a level below the upper end of the well and above the contact lens to limit movement of the lens towards the upper end of the well.

Preferably, the retaining means is formed on the container well concave surface and comprises an inwardly extending projection providing a lip beneath which the lens is seated. The projection extends about less than 300° of the circumference of the well to enable the contact lens to be moved by the fingertip of a user through the spacing between the spaced ends of the projection. Desirably, the projection extends about at least 200° of the circumference of the well. The lip may be continuous or comprise a multiplicity of circumferentially spaced projections.

In another embodiment, the retaining means is formed on the cover and comprises a depending portion thereon extending into the well. The depending portion abuts the concave surface of the well and may be generally cylindrical, or it may be generally annular. The container has a flange extending outwardly about the circumference of the well, and the cover is sealingly engaged with the flange.

DETAILED DESCRIPTION OF THE PREFERRED EMBODIMENTS

Figure 1:
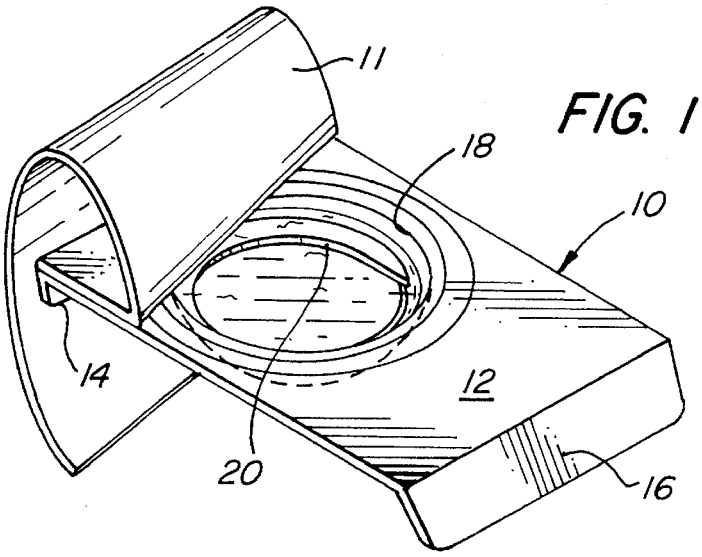
FIG. 1 is a perspective view of a lens storage container embodying the present invention with the closure partially removed.
Figure 2:
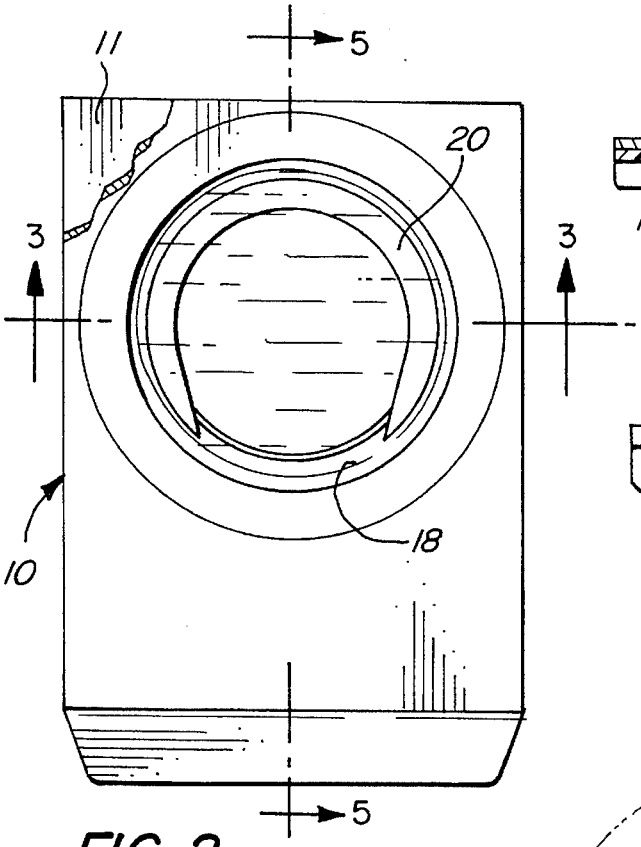
FIG. 2 is a plan view of the lens storage container of FIG. 1 with the closure broken away.

Turning first to FIGS. 1–6, a lens storage container embodying the present invention is illustrated as comprising a receptacle generally designated by the numeral 10 and a closure 11. The receptacle 10 has a planar body portion 12 of generally rectangular configuration having depending leg portions 14 and 16 at opposite ends thereof, and a centrally disposed well 18 of generally spheroidal configuration. Extending about the inner periphery over an arc of about 300° adjacent the upper end of the well 18 is an inwardly extending lip 20. This well 18 provides a compartment to contain the stored contact lens 22 and an appropriate wetting solution 24.

The closure 11 is sealingly engaged with the body portion 12 about the well 18. The container is elongated and the well 18 is located closer to one end thereof. The spacing between the ends of the lip 20 is oriented towards the other end of the receptacle 10.

Figure 3:
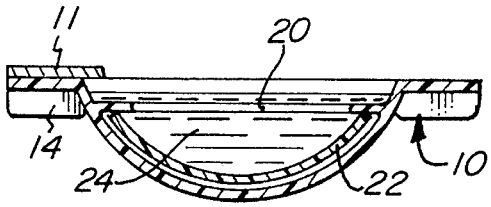
FIG. 3 is a sectional view thereof along the line 3—3 of FIG. 2.
Figure 4:
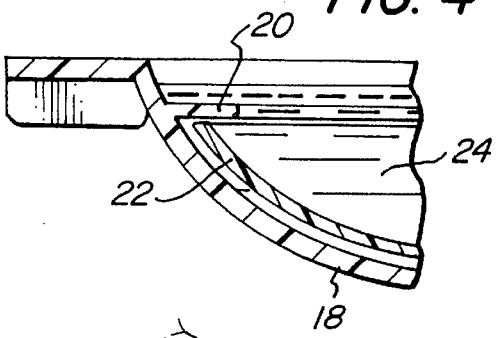
FIG. 4 is an enlarged portion of FIG. 3.
Figure 5:
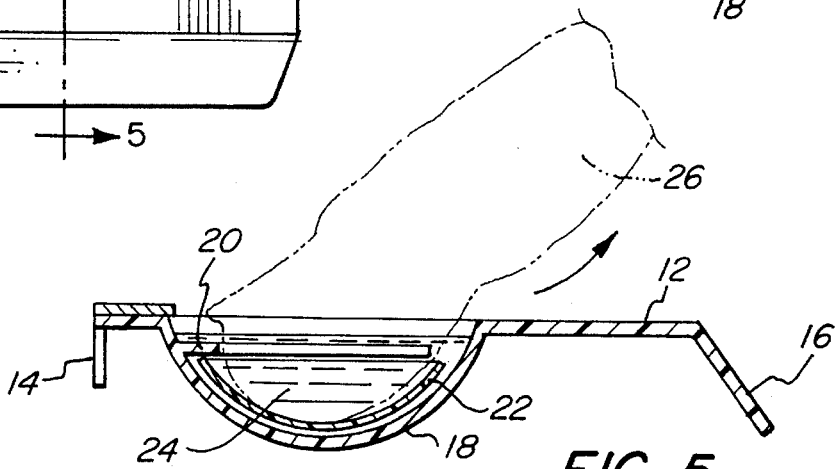
FIG. 5 is a sectional view along the line 5—5 of FIG. 2 with the closure fully removed and a user's finger positioned to remove the lens.

As seen in FIGS. 3–5, the contact lens 22 seats in the well 18 which has a similar radius of curvature and its circumferential edge is adjacent but spaced from the lip 20. The well 18 also contains a saline wetting solution 24 to keep the lens 22 saturated.

When the user desires to remove the lens 22, the closure 11 is peeled from the body portion 12 and the user inserts a finger 26 into the well 18. Capillary action will usually cause the lens 22 to adhere to the fingertip and the lens 22 may be moved along the surface of the well 18 through the spacing between the ends of the lip 20.

Figure 6:
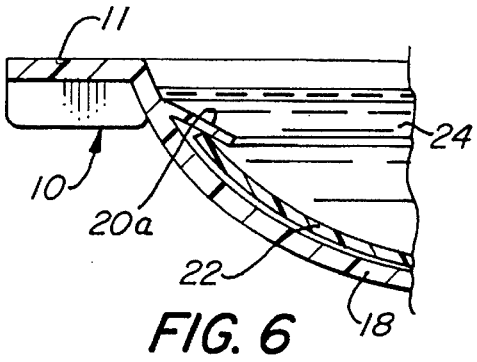
FIG. 6 is a fragmentary sectional view of another embodiment of a contact lens storage container embodying the present invention with the closure broken away.

Turning next to FIG. 6, in this embodiment the lip 20*a* is inclined downwardly.

Figure 7:
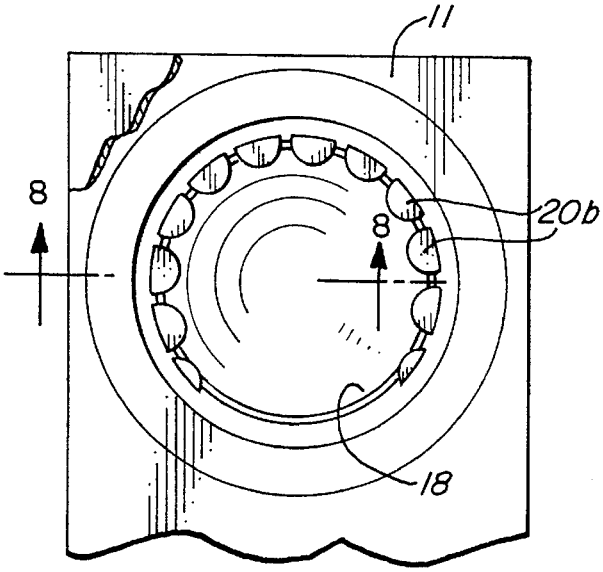
FIG. 7 is a plan view of another embodiment of a contact lens storage container embodying the present invention with the closure broken away.
Figure 8:
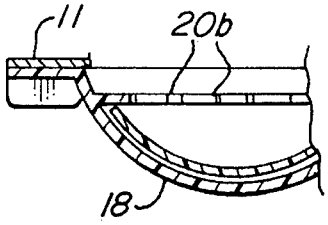
FIG. 8 is a fragmentary sectional view along the line 8—8 of FIG. 7.

In FIGS. 7 and 8, the embodiment is one in which the lip 20*b* comprises a series of spaced, small projections 20*b*.

Figure 9:
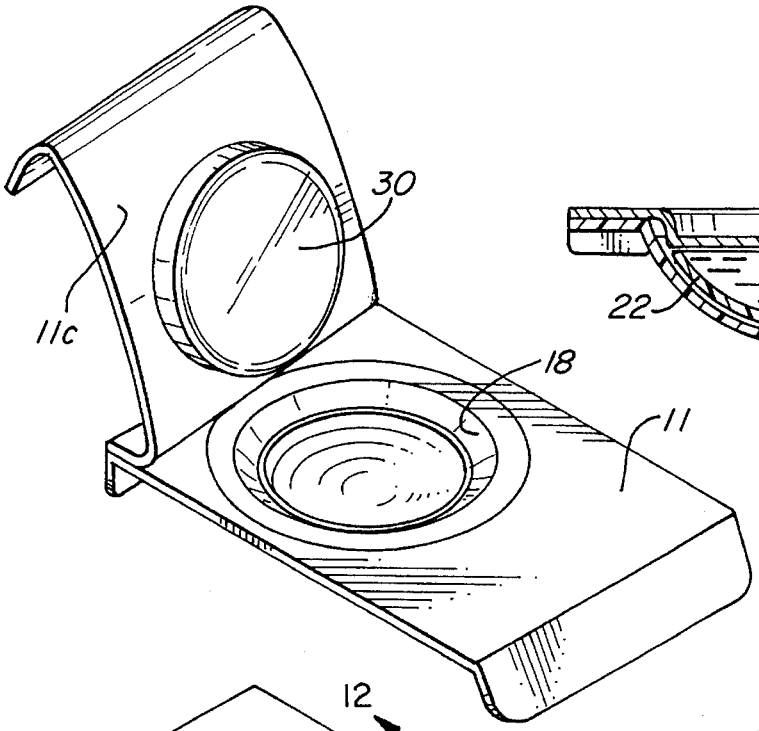
FIG. 9 is a perspective view of another embodiment of the container of the present invention with the closure partially removed.
Figure 10:
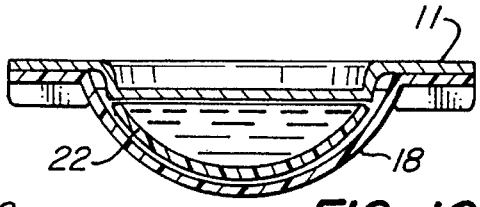
FIG. 10 is a sectional view of the container of FIG. 9 with the closure in place.

Turning next to FIGS. 9 and 10, this embodiment has a closure 11*c* with a depending cylindrical portion 30 which seats within the well 18 to a depth just above the lens 22.

Figure 11:
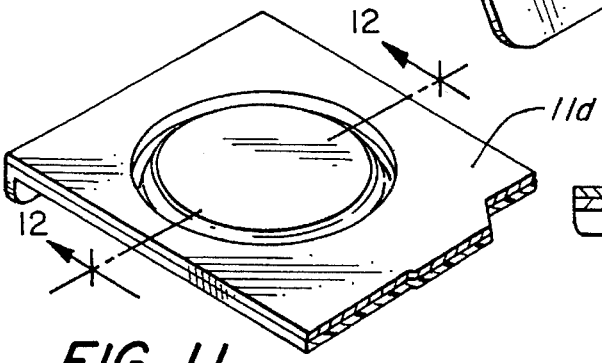
FIG. 11 is a fragmentary perspective view of another embodiment of the container.
Figure 12:
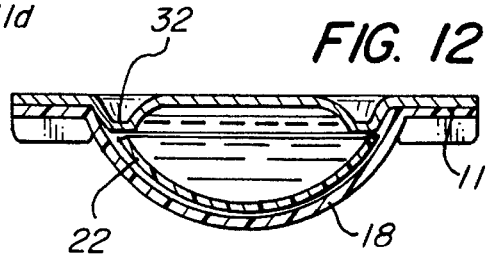
FIG. 12 is a sectional view along the line 12—12 of FIG. 11.

In the embodiment of FIGS. 11 and 12, the closure 11*d* has a ring-like or annular depending rib 32 which extends downwardly into the well 18 to limit movement of the lens 20.

In the each of the embodiments of FIGS. 1–8, the lip 20 extends about only a portion of the circumference of the well 18 so that it retains the lens 22 in the well therebelow and in the orientation in which it is placed therein. However, the lens 20 may be slid outwardly along the surface of the well 18 through the spacing in the lip 20 because the lens 18 will deflect.

In the embodiments of FIGS. 9–12, the depending portion of closure serves to keep the lens 22 in its orientation in which placed in the well 18.

The radius of curvature of the well should approximate the radius of curvature of the human cornea or about 5.7 to 11.7 millimeters, and preferably about 8.7 millimeters.

In using the storage container of the present invention, the manufacturer of the soft contact lens places the lens in the well in a predetermined orientation. Because the radius of curvature of the well is similar to that of the cornea of a human eye, the lens tends to adhere to its surface by means of capillary attraction, which also keeps a lens against the human cornea when the lens is placed in the eye. Although sudden movements would tend to displace the lens placed from the surface of the well, the lens will be retained in the well by the lip, or by the depression in the closure so that inversion is not likely.

It does not make a significant difference whether the lens is disposed in the well right side out or inside out. Since the lens is typically made from a very thin membrane, the lens will readily deform or adhere in either orientation. The orientation selected will usually depend upon the manufacturing process employed, and the user of the lens can be advised of the chosen orientation to allow for proper orientation of the lens in the eye upon removal from the container.

The receptacle of the lens storage container of the various embodiments is readily formed from synthetic resin by injection molding although thermoforming and compression molding may also be employed. The dimension of the lip can be very small since it need only resist movement of the lens outwardly along the surface. As little as 0.005 inch will be sufficient, and projections of 0.05 inch in length, i.e., in the circumferential direction, can be spaced apart by 0.25 inch or more. By proper selection of the resins, the projections and lip can be formed in one step without using a collapsible plug because the lip or projections will flex to allow removal of the lens from the tooling.

Various resins may be employed to from the receptacle including polyethylene and polypropylene which are relatively economical. The closure or cover may be a metallic foil using an adhesive or a foil with a laminated layer or coating of resin which enables heat sealing to provide a suitable bond to the flange. However, a resin should be employed when the closure is to provide a depending portion to extend into the well.

Thus, it can be seen from the foregoing detailed specification and attached drawings that the disposable lens storage container of the present invention provides convenient location of the lens and facilitates removal of the lens from the container to minimize the potential for damage to the lens during removal. The container may be fabricated readily and economically.

I claim:

1. A package containing a contact lens and saline solution comprising:

(a) a container providing a well with a concave surface having a first radius of curvature;

(b) a concave contact lens disposed in said well adjacent said concave surface and having a second radius of curvature approximating that of said container concave surface;

(c) saline solution in said well about said lens; and (d) a removable cover extending over said container to seal said contact lens and saline solution in said well, said container well having retaining means extending inwardly of said concave surface of said well below the upper end of said well and above said contact lens, said retaining means extending about at least 200° of the circumference of said well and inwardly of the periphery of said lens to limit movement of said lens towards said upper end of said well.

2. The contact lens package in accordance with claim 1 wherein said retaining means comprises an inwardly extending projection on said concave surface providing a lip below which said lens is seated.

3. The contact lens package in accordance with claim 2 wherein said projection extends about not more than 300° of the circumference of said well to provide spacing between the ends of said projection to enable said contact lens to be moved by the fingertip of a user through said spacing between the spaced ends of said projection.

4. The contact lens package in accordance with claim 2 wherein said lip comprises a multiplicity of circumferentially spaced projections.

5. The contact lens package in accordance with claim 1 wherein said container has a flange extending outwardly about the circumference of said well.

6. The contact lens package in accordance with claim 5 wherein said cover is sealingly engaged with said flange.

7. A package containing a contact lens and saline solution comprising:

(a) a container providing a well with a concave surface having a first radius of curvature;

(b) a concave contact lens disposed in said well adjacent said concave surface and having a second radius of curvature approximating that of said container concave surface;

(c) saline solution in said well about said lens; and (d) a removable cover extending over said container to seal said contact lens and saline solution in said well, said container well having an inwardly extending projection providing a lip on said concave surface of said well below the upper end of said well and above said contact lens to limit movement of said lens towards said upper end of said well, said projection extending over and inwardly of the periphery of said lens, said projection extending about 200°– 300° of the circumference of said well to provide spacing between the ends of said projection to enable said contact lens to be moved by the fingertip of a user through the spacing between the spaced ends of said projection.

8. The contact lens package in accordance with claim 7 wherein said lip comprises a multiplicity of circumferentially spaced projections.

9. The contact lens package in accordance with claim 7 wherein said container has a flange extending outwardly about the circumference of said well and said cover is sealingly engaged with said flange.

* * * * *